United States Patent [19]

Bigelow et al.

[11] 4,129,390

[45] Dec. 12, 1978

[54] STACKED BLADE MATRIX PRINTER HEADS

[75] Inventors: John E. Bigelow, Rexford; Donald C. Peroutky, Schenectady, both of N.Y.

[73] Assignee: General Electric Company, Schenectady, N.Y.

[21] Appl. No.: 845,425

[22] Filed: Oct. 25, 1977

Related U.S. Application Data

[63] Continuation of Ser. No. 687,985, May 19, 1976, abandoned.

[51] Int. Cl.[2] ..... B41J 3/12

[52] U.S. Cl. ..... 400/121; 101/93.04; 101/93.29; 101/93.48; 361/402

[58] Field of Search ..... 361/402; 40/359, 360; 197/1 R; 101/93.48, 93.28, 93.29

[56] References Cited

U.S. PATENT DOCUMENTS

| | | | |
|---|---|---|---|
| 2,502,785 | 4/1950 | Gottschalk | 40/360 |
| 2,659,652 | 11/1953 | Thompson | 197/1 R |
| 3,217,640 | 11/1965 | Bradshaw | 197/1 R |
| 3,270,349 | 8/1966 | Murphy | 101/93.04 |
| 3,325,821 | 6/1967 | Reese et al. | 101/93.04 |
| 3,947,934 | 4/1976 | Olson | 361/402 |
| 3,968,744 | 7/1976 | Kash et al. | 101/93.48 |
| 3,971,311 | 7/1976 | Deproux | 101/93.04 |
| 4,022,311 | 5/1977 | Krull | 101/93.34 |

FOREIGN PATENT DOCUMENTS

| | | | |
|---|---|---|---|
| 967808 | 5/1975 | Canada | 101/93.48 |
| 1227531 | 10/1966 | Fed. Rep. of Germany | 336/200 |
| 1241667 | 8/1971 | United Kingdom | 101/93.48 |
| 1376305 | 3/1974 | United Kingdom | 101/93.48 |
| 1376645 | 1/1975 | United Kingdom | 101/93.48 |

*Primary Examiner*—William Pieprz

*Attorney, Agent, or Firm*—Geoffrey H. Krauss; Joseph T. Cohen; Marvin Snyder

[57] ABSTRACT

A printer head for use in an impact printer of the dotmatrix type utilizes a stack of pivoted thin blades, each having a printing tip at one end thereof. A pancake coil is attached to each blade for initiating selective independent movement thereof within a common, externally-produced magnetic field to efficiently convert electrical print signals to kinetic energy in each printing tip of a vertical array thereof thereby facilitating printing of symbols, characters and other indicia on underlying media with high resolution. The single magnetic-field-producing means interacts with all pancake coils of the stack of printer blades to facilitate close spacing of the printing tips for superior character printing. Resilient members are integrally formed in each blade to support the moving structure with negligible loss, thereby increasing the printing speed of the stacked blade head.

7 Claims, 15 Drawing Figures

Fig. 1
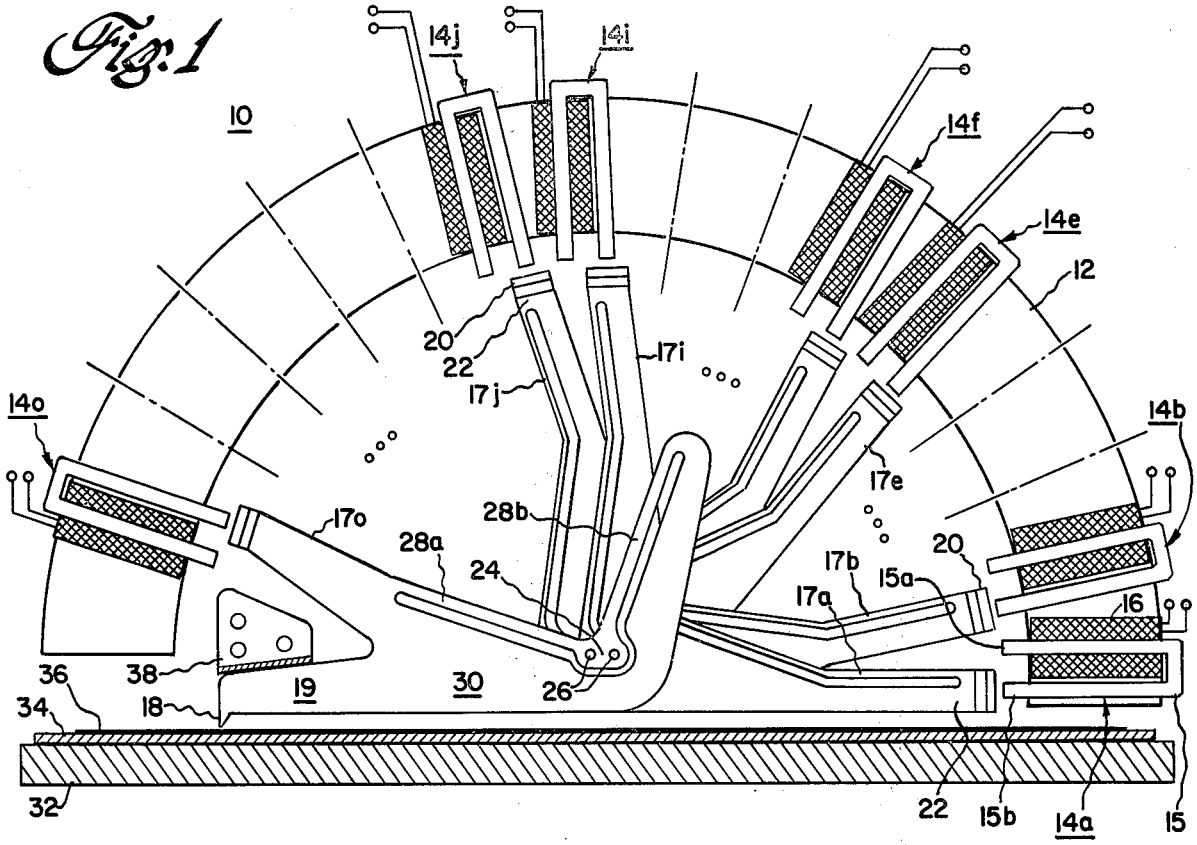
Fig. 2
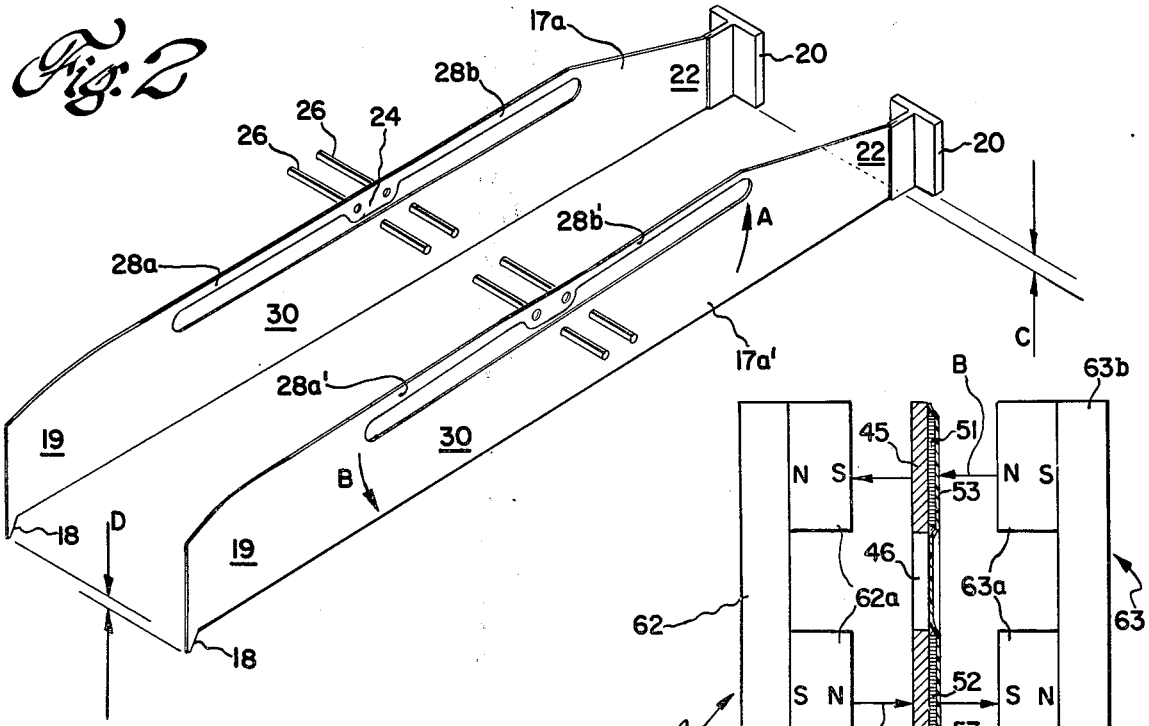
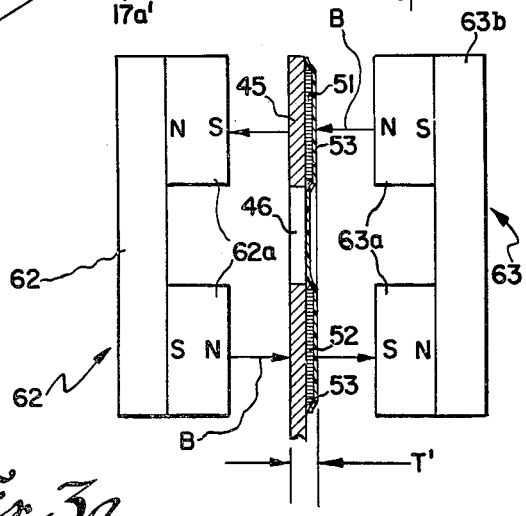
Fig. 3a

Fig. 3
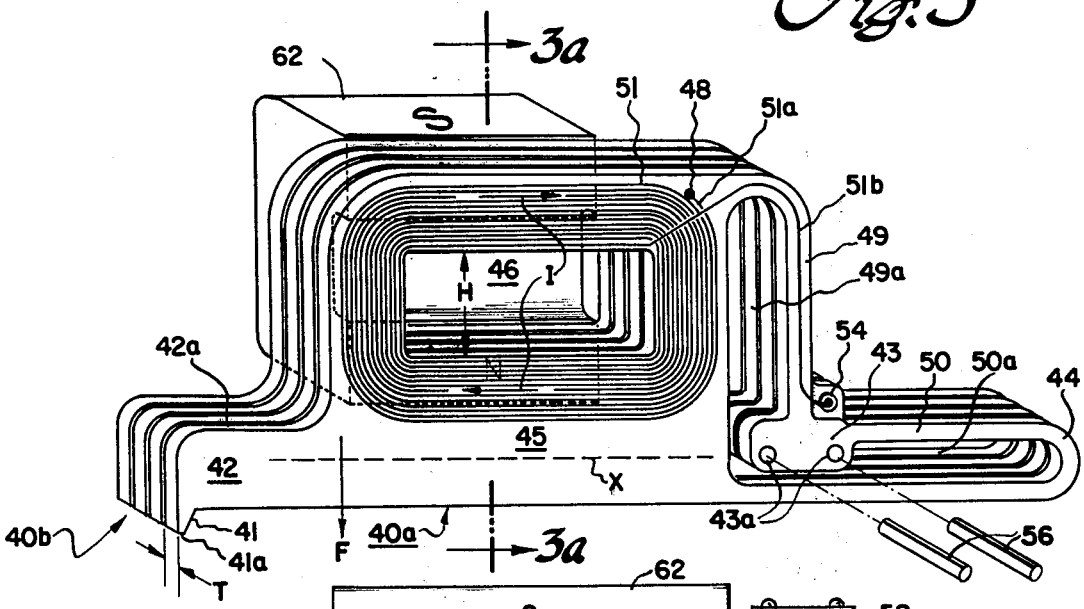
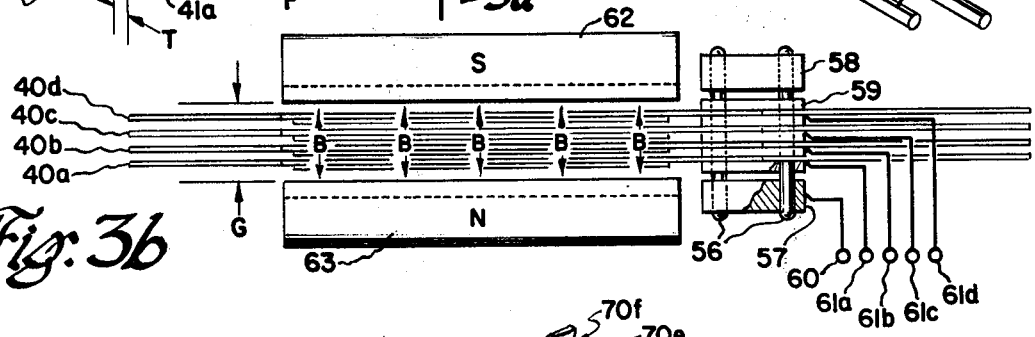
Fig. 3b
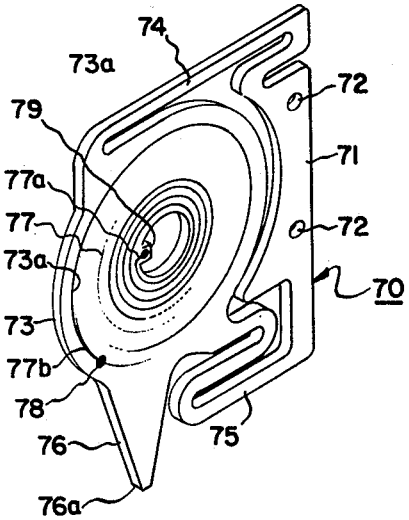
Fig. 4
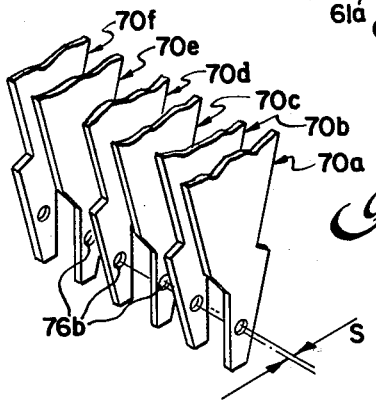
Fig. 5a
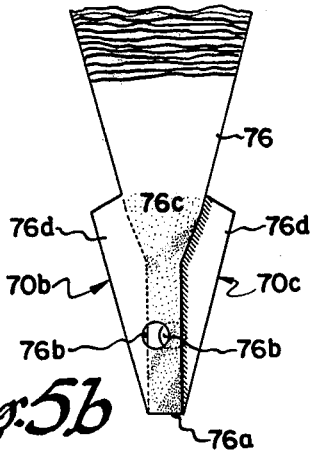
Fig. 5b
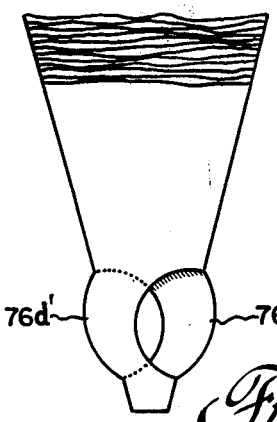
Fig. 5c

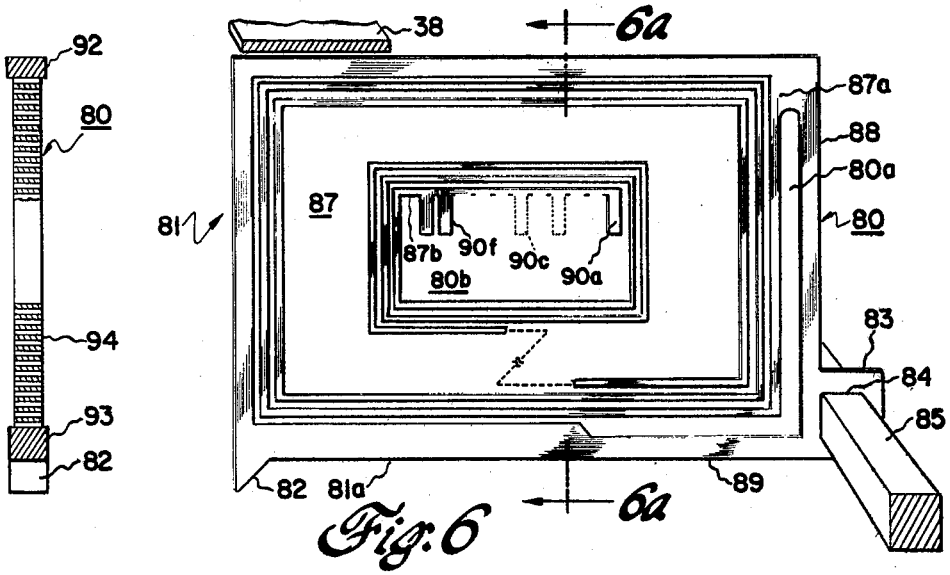
Fig. 6a
Fig. 6
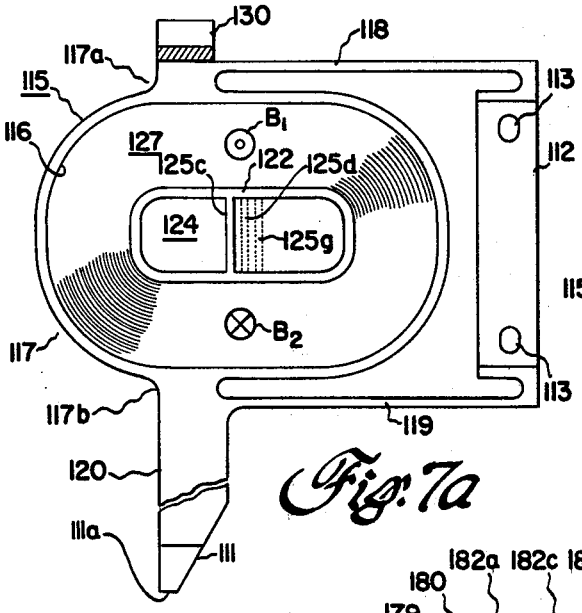
Fig. 7a
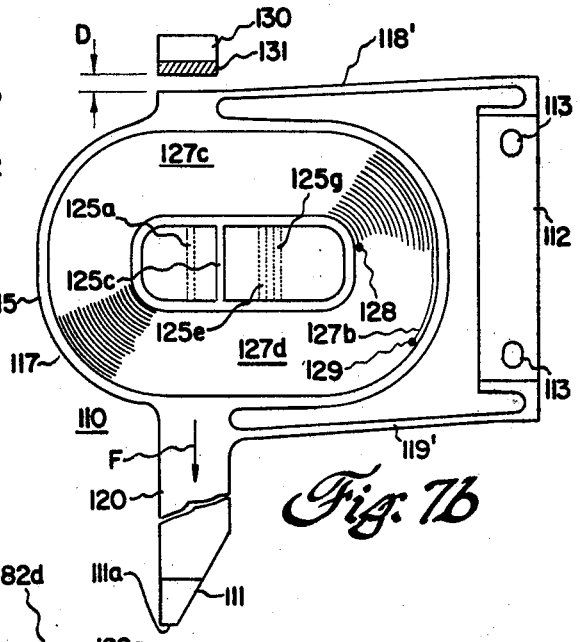
Fig. 7b
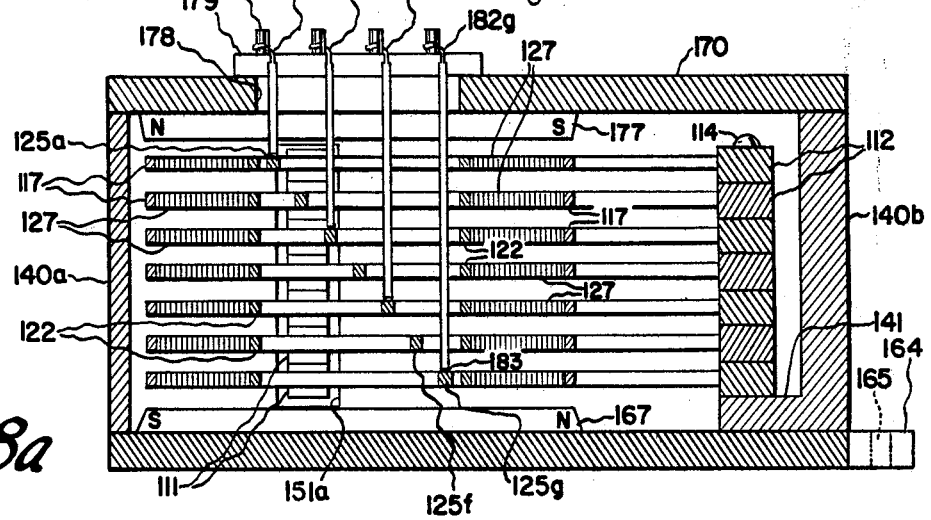
Fig. 8a

STACKED BLADE MATRIX PRINTER HEADS

This is a continuation, of application Ser. No. 687,985, filed May 19, 1976 now abandoned.

BACKGROUND OF THE INVENTION

The present invention relates to information printers of the dot-matrix type and, more particularly, to novel stacked blade arrangements for the printhead thereof.

Mechanisms capable of printing characters, symbols and the like along a line upon underlying media, such as a paper document and the like, have been generally classifiable into one of two types: whole-character and dot-matrix.

One known embodiment of a whole-character printer utilizes a drum, having a raised-type portion for forming each indicia printable, which rotates adjacent one face of the printing media; a relatively wide hammer member is electrically actuated to impact the remaining surface of the printing media and press the media and an inked ribbon against the rotating indicia drum at the exact instant that the desired character is passing thereunder. As is obvious, the synchronization problems associated with a whole-character printer are awesome, particularly when individual drums are stacked in side-by-side manner along a print line typically containing up to 132 character positions, with all 132 individual striking hammers requiring separate synchronization with only that one of the continuously rotating drums associated therewith.

The dot matrix printer attempts to overcome this problem by incrementally forming each sequential character by selective impingement of one or more print elements arranged along a vertical line. In a typical application, seven print wires have their tips arranged along the vertical line and each print wire is energized by an associated solenoid means to print a single dot on the vertical line. As the printhead moves to five equally spaced, sequential column positions (with a sixth column being left empty to provide a space between characters), the print wire tips impinge upon the printing media to form the desired character pattern.

This approach has the general limitations of: somewhat poor character legibility; inability of the printer to form upper and lower case characters due to low density patterns; and excessive frictional wear both between the print wires and their guides and between the print wires and the inked ribbon. Additionally, each print wire must be driven by a separate solenoid, having its own individual magnetic structure with most of the length of an iron flux path therein being excited by the solenoid coil such that an armature, attached to the printing wire, is caused to move to close the flux path. This complex and costly construction for a dot-matrix printhead is undesirable, as is the consequent saturation of the magnetic structure and high printing wire reciprocating speeds. Apparatus is desired which overcomes many, if not all, of the wire-type dot-matrix printer problems, while enabling a relatively simple and cost-effective construction even with high matrix density print capability.

BRIEF SUMMARY OF THE INVENTION

In accordance with the invention, a print head for a dot-matrix printer comprises a plurality of stacked printing blades, each blade having a fixed pivot portion attached to a common member and a first end including a printing tip, with the printing tips of all of the plurality of blades being arranged along a common line. Each print blade includes a flat, or pancake, coil and integral resilient means for enabling the print tip to move relative to the fixed pivot portion responsive to force generated by the coil being energized by a flow of current therethrough while the coil is positioned in a magnetic field formed by single means external to the stack of blades. In one preferred embodiment, the coil is etched directly into the body of each matrix blade, with a plurality of contact fingers positioned along a first coil end and the remaining coil end being directly connected to the blade element. All but one of the fingers are removed from the first coil end to provide a staggered, single, contact for each blade of the stack In another preferred embodiment, a flat coil is wound upon a center member having an integral contact cross-piece, with the coil-contact combination being bonded into a central cutout formed in each printer blade.

In still another preferred embodiment, the above-mentioned coil-contact arrangement is positioned in a loop of blade material positioned directly over the printer tip, with printer tip and pivot portion being intentionally thickened to provide substantially continuous matrix printer portions while enabling the remainder of the blade to be relatively thinner, thereby reducing side-to-side friction between adjacent blades and improving the operating speed thereof.

Accordingly, it is one object of the present invention to provide a novel arrangement of stacked printing blades for use in a dot matrix type printer.

It is another object of the present invention to provide novel printing blades having integral resilient means for providing return force after each blade is deenergized.

It is still another object of the present invention to provide novel stacked dot matrix printing blades having integral driving coil means of no greater thickness than the thickness of the relatively thin blade itself.

These and other objects of the present invention will become apparent to those skilled in the art upon a consideration of the following detailed description and the drawings.

A BRIEF DISCUSSION OF THE DRAWINGS

FIG. 1 is a side view of a high-resolution embodiment of a stacked blade printing head in accordance with the principles of the present invention;

FIG. 2 is an isometric view of a printing blade of FIG. 1 in the unenergized condition and in the energized condition;

FIG. 3 is an isometric view of a stacked plurality of a second embodiment of a stacked blade printer head in accordance with the principles of the invention;

Figure 8:
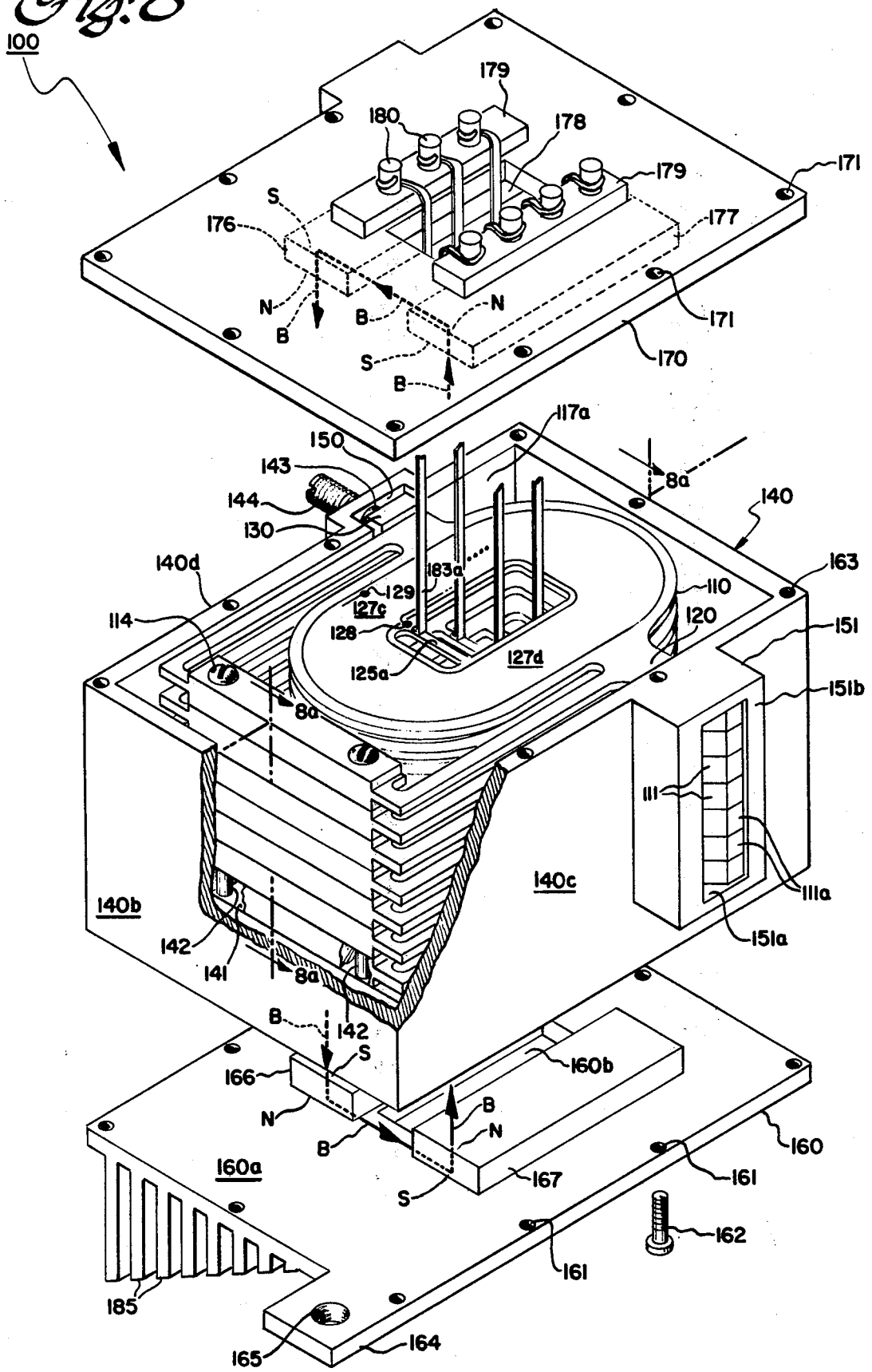

FIG. 3*a* is a sectional view of one printer blade of the stack of FIG. 3, taken along lines 3*a*—3*a;*

FIG. 3*b* is a top view of the printer blade stack of FIG. 3 illustrating means for forming the external magnetic field and the manner in which the fixed pivot and coil connections are achieved;

FIG. 4 is an oblique view of a third embodiment of a stacked blade printer head;

FIG. 5*a* is an exploded isometric view of a stacked plurality of printer blades illustrating details of one printing tip embodiment;

FIGS. 5*b* and 5*c* are side views of a stacked plurality of printing tips illustrating means for preventing ink wicking therebetween.

FIG. 6 is an oblique side view of an embodiment of flat printer blade hving an etched, integral coil;

FIG. 6a is a sectional view of the printer blade embodiment of FIG. 6 and taken along lines 6a—6a;

FIGS. 7a and 7b are side views of another embodiment of flat printer blade in respectively the unenergized condition and the energized, or flexed, condition;

FIG. 8 is a partially-sectioned, exploded oblique view of a print head having a stack-mounted plurality of the printer blades of FIGS. 7a and 7b and illustrating the manner by which connections to the pancake coils thereof are facilitated; and FIG. 8a is a sectional view of the print head, taken along lines 8a—8a of FIG. 8.

DETAILED DESCRIPTION OF THE INVENTION

Referring intially to FIGS. 1 and 2, a high-resolution-capability stacked blade print head 10 comprises a semi-circular housing 12 having a plurality of magnetic means 14 mounted at equiangular positions thereabout. Each of magnetic means 14 includes a U-shaped pole piece 15 having a solenoid coil 16 around one leg thereof. A like plurality of printer blades 17, illustratively being 15 in number, are each formed of a thin sheet of durable non-magnetic material, such as metal and the like, with each blade 17 having a printing tip 18 extending downwardly at a first end 19 thereof. An armature 20, formed of a magnetic material, is attached at a second end 22 of each blade, adjacent an associated magnetic means 14. A fixed pivot portion 24, located substantially at the center of mass of each blade 17, is fixedly mounted to frame members (not shown for purposes of simplicity) at the center of housing 12 by means of a plurality of pins 26. Each blade member 17 includes a pair of elongated resilient spring arms 28a, 28b respectively extending in opposite directions from central portion 24 and spaced from a beam portion 30 of each blade along part of the length thereof. Arms 28a, 28b join beam portion 30 respectively at first end 19 and second end 22, respectively.

When the coil of the magnetic means 14 associated with a particular armature 20 (such as magnetic means 14a for the armature attached to blade 17a) is energized by a flow of current therethrough, the resulting magnetic field attracts armature 22 toward arm 15a to apply an upward torque, in the direction of arrow A, to the associated blade end 22. Each resilient spring arm 28a and 28b, respectively, bends in an opposite direction responsive to the applied torque to facilitate substantially frictionless rotation of the arm about its fixed pivot portion 24. As illustrated, the solenoid armature end 22 of each blade is positioned at a different angle with respect to aligned first ends 19 to accommodate the semi-circular positioning of magnetic means 14.

Print head 10 is positioned above a platen 32 which supports media 34, upon which symbols, characters and other indicia are to be printed. An inked ribbon 36 is interposed between the top surface of media 34 and the aligned row of print tips 18, whereby, when at least one magnetic means 14 is energized, the printing tip 18 of the associated blade (or blades) 17 is thrust against ribbon 36 and media 34 to leave a discernible mark upon the latter.

In the resting condition (FIG. 2) each print blade, typically illustrated by blade member 17a, has, in its deenergized (or "unflexed") condition, its printing tip 18 positioned at a distance D above ribbon 36 and underlying media 34 as maintained by the unflexed elongated resilient spring arms 28a and 28b. Upon energization of the associated magnet means 14, magnetic armature member 20 is, as previously mentioned, drawn upwardly a distance C toward arm 15a, whereby torque is placed upon blade end 22 to rotate that end upwardly in a counterclockwise direction, as indicated by arrow A. As the beam 30 of each printer blade is relatively wide and, therefore, stiff (whereas each resilient spring arm 28 is of sufficiently thin dimension to flex), first blade end 19 is caused to rotate downwardly, as indicated by arrow B, about fixed pivot portion 24 to cause printing tip 18 to move through distance D and impact ribon 36 against media 34 leaving a printed ink dot thereon. Upon deenergization of the associated magnet means 14, the energy stored in flexed resilient arms 28a', 28b' will produce a torque on blade 17 in a direction opposite arrows A and B to return the blade to its original unenergized position with armature 20 adjacent the remaining polepiece arm 15b. A stop member 38 (FIG. 1) is positioned at a height above platen 32 selected to bring the returning blade to a halt at its rest position without excessive bounce, which may (if not prevented) allow the blade to vibrate freely about pivot portion 24 upon deenergization of magnetization means 14, with subsequent printing of a second dot.

While this embodiment allows a relatively large number, typically 15, of blades to be aligned for dot-matrix printing of high resolution as required for reproduction of characters in many non-English languages, such as Russian and Chinese, the relatively high mass and size of this configuration places a relatively low print speed limitation thereon.

Referring now to FIGS. 3, 3a and 3b, a second preferred embodiment of a stacked blade printing head (having smaller size, lower mass and, hence, higher maximum printing speed) comprises a plurality of individual thin blades 40 each having a printing tip 41 with generally square impact surface 41a at a first end 42 thereof and a fixed pivot portion 43 at a point removed from a remaining end 44 thereof. A central, generally rectangular portion 45 of each blade has an aperture 46, of similar shape but of reduced dimensions, formed therethrough. A first resilient arm 49, connecting fixed pivot portion 43 to that corner of central portion 45 diagonally opposite first end 42, and a second resilient spring arm 50, connecting fixed pivot portion 43 to remaining blade end 44 and having its elongated shape generally transverse to the elongation of first spring arm 49, are both integrally formed from the thin sheet of non-magnetic material from which each blade 40 is produced, by relieving a pair of connected elongated apertures 49a and 50a, respectively, between the elongated spring arms and the parallel adjacent portions of the blade.

A multi-turn coil 51 is preferably formed of wire having a square or rectangular cross-section to facilitate positioning coil 51 in abutment to a flat surface of rectangular portion 45 of each blade (FIG. 3a). Coil 51 is permanently maintaned upon the surface of non-magnetic plate portion 45 and around the periphery of aperture 46 by securement thereat with a suitable adhesive 52, such as epoxy and the like, saturated through the interstices of coil 51 to the surface of blade portion 45. Preferably, a film 53 of a low friction plastic material is layed over the exterior surface of coil 51 to be bonded thereat by adhesive 52. Film 53 provides a low-friction surface for blade 40a, upon which an adjacent blade may slide if torsional forces tend to warp blade 40*a* in a direction perpendicular to the plane thereof. Similarly, blade 40*a* will slide in low-friction manner upon the film 53 of the blade 40*b* adjacent the side of blade 40*a* devoid of coil 51.

A first end 51*a* of each coil is electrically connected, as by ultrasonic bonding and the like, at a point 48 on central blade portion 45, with the electrical connection being carried through the conductive material of first spring arm 49 to fixed pivot portion 43, to form a first electrical contact for coil 51. The insulated remaining coil end 51*b* is secured by suitable adhesive, such as epoxy and the like, along the elongated length of first spring arm 49 to terminate at an insulated conductive pad 54 positioned upon fixed pivot portion 43, to provide an independent second coil contact for use as further explained hereinbelow.

A plurality of identical blades 40 are stack positioned one adjacent the other and maintained in this arrangement by a plurality of pins 56 passing through apertures 43*a* in fixed pivot portion 43. Thus, as illustrated in FIGS. 3 and 3*b*, a stack of four blades 40*a*–40*d* are maintained between a pair of opposed frame members 57 and 58, respectively, with a plurality of thin spacing means 59 being inserted between each pair of blades and each outer blade and the adjacent frame member to space the protective film 53 of any blade, e.g. 40*b*, from the surface of an adjacent blade, such as 40*a*. Preferably, each spacer 59 is formed of a conductive material and each pin 56 is firmly electrically connected to pivot portion 43, whereby a common electrical parallel connection is achieved between common electrical terminal 60 and each first end contact 48 of the plurality of blade coils 51. Similarly, a flexible lead 61*a*–61*b*, respectively, is brought out from each insulated terminal 54 of each blade 40*a*–40*d*, respectively, of the stack, whereby a current caused to flow between each individual coil terminal 61*a*–61*b* and common terminal 60 energizes the associated coil 51.

A pair of permanent magnetic structures 62 and 63, respectively, have their magnetic poles in opposed relationship and positioned adjacent the coil conductors substantially parallel to an imaginary line X (shown as a broken line in FIG. 3) between first end 42 and pivot portions 43, for generating a single external magnetic field passing through each of the stack of coils upon the non-magnetic blades. As best seen in FIG. 3*a*, each magnetic structure 62 and 63 includes a pair of permanent magnets 62*a* and 63*a* respectively, each magnetized in its thickness direction and attached to one of soft iron polepieces 62*b* or 63*b*, respectively, to close that portion of their magnetic circuits opposite the stack of blades 40. The poles of each magnet of each pair, as well as the poles of pairs 62*a*, 62*a* and 63*a*, 63*a*, are in opposition to generate a magnetic field B directed in opposite directions through portions of coil 51 parallel to line X but conducting a flow of current in opposite directions.

As is well known, a flow of current I through a conductor in a magnetic field B, produced between the adjacent magnetic poles of opposite polarity, produces a vector force F directed in the direction given by the vector-cross-product of magnetic vector B and current vector I. Thus, upon energization of any coil, such as coil 51 of blade 40*a*, a force is produced in the direction of arrow F to cause first blade end 42 to be pivoted about the relatively small pivot portion 43 and against the resilience force of elongated spring arms 49 and 52. Force F accelerates print tip 41 in a downward direction to impact substantially square printing surface 41*a* against the underlying inked ribbon to produce an inked dot of substantially square shape upon underlying media. As previously explained hereinabove, energization of selected patterns of the coils 51 for each of the blades in the stack causes the desired patterns of dots to be printed to form the selected characters, symbols and like indicia.

Upon cessation of current flow between one of individual coil inputs 61*a*–61*d* and common coil terminal 60, the electromagnetic interaction between the associated coil 51 and magnetic field B, produced by the opposite polarity magnetic poles of permanent magnets 62*a* and 62*b*, ceases, whereby the potential energy stored in resilient spring arms 49 and 50 causes rotation of first blade end 42 and the substantially rectangular blade portion 45 in a generally clockwise direction, opposed to the direction of arrow F, about fixed pivot portion 43, to return the previously rotated blade to its rest position. It should be understood that a stop member, such as stop 38 of FIG. 1, may be positioned adjacent the upper surface 42*a* of first end 42, to bring each blade to a halt without bounce and subsequent printing of a second, undesired square dot.

As will be evident, this second embodiment of a stacked plurality of dot-matrix printing blades is of considerably less mass and size than the configuration shown in FIG. 1, as a plurality of individual magnetic means 14 (FIG. 1) are not required and are replaced by a single permanent magnetic structure adjacent the sides of the entire blade stack. This saving in size and mass is considerable if modern rare-earth permanent magnets, having exceptionally high flux ratings, are utilized for magnets 62*a* and 63*a*. The saving in size and weight allows reduced complexity and cost of mechanisms (not shown) for enabling the travel of the print head across the width of the underlying media, to print a full line of indicia; the reduced size and mass of the individual print blades 40 themselves allow more rapid printing as a lesser magnitude of blade inertia must be overcome, whereby the same coil current, producing like forces, facilitates increased acceleration to ribbon-paper impact to reduce the time required for a complete dot-printing cycle.

Typically, each blade 40 (in a seven-blade high stack for printing a 5 × 7 matrix symbol), will have a thickness T of about 12 milli-inches (mils), while the substantially rectangular wire used for coils 51 will have a 5.5 × 11 mil cross-section, whereby the total blade thickness T′ (FIG. 3*a*) is of the order of 18 mils. Thus, a closely spaced stack of seven blades will realize a character height of 0.125 inches. Utilizing a coil having dimensions of 1.8 × 2.8 centimeters, with an aperture 46 having a height H of 0.6 centimeters, a coil having approximately 2 ohms resistance is facilitated, and using the aforementioned rare-earth magnets, such as GE-COR® magnets and the like, having a cross-sectional area and thickness associated with the total area of gap G (FIG. 3*b*), a flux of the order of 4–5 kilogauss is realized in the gap area. For movement of print tip 41*a* over a distance D of 20 mils, at a character rate of 100 characters per second, a value of kinetic energy in excess of that obtainable from many wire matrix printers is facilitated for a coil current on the order of 2 amperes. This drive energy requirement is considerably less than that required for many known print wire solenoid drive means, whereby a solid state solenoid driver (not shown) utilizes switching devices having lower peak current and voltage ratings, thereby reducing printer costs.

Referring now to FIG. 4, another embodiment of a printer blade 70 is particularly adapted for generating the relatively large impact forces necessary to print upon a sheet of media and a plurality of underlying sheets of carbon paper for duplicate copies. Blade 70, having an elongated fixed pivot support 71 with a plurality of apertures 72 formed therethrough for receiving mounting pins (not shown for purposes of simplicity), comprises a generally circular intermediate portion 73 having a central, substantially circular aperture 73*a* formed therethrough with the remaining annulus supported at substantially diametric points by each of a pair of convoluted and meandering resilient spring means 74 and 75, respectively, integrally joined to opposed ends of elongated support 71. A somewhat triangular printing tip 76 extends from circular portion 73 to have its impact face 76*a* below the outermost fold of lower resilient arm 75.

A coil 77 of insulated wire is wound upon a circular ring-shaped member 78 of conductive material. Member 78 advantageously possesses a short, radially inwardly directed stub 79 to which a first end 77*a* of coil 77 is electrically connected. A preferred single layer coil 77 is preferably formed of wire having a somewhat flattened corss-section to facilitate the winding. The finished winding is encapsulated in suitable adhesive to hold the coil to member 78 and to maintain the coil shape. The use of an aluminum wire is especially attractive, as the insulation required between turns is facilitated by the formation of a layer of insulating aluminum oxide upon the wire after shaping of its cross-section but prior to winding of the coil.

Coil 77, wound about member 78 to a diameter essentially equal to that of aperture 73*a*, is placed within the central portion aperture coplanar with the blade and cemented therein. A second end 77*b* is bonded in electrical connection with an intermediate section of portion 73 of the blade at point 70*a*, with the conductive material of the blade forming the remainder of a second coil lead to pivot support 71, for connection in common to all of the stacked coils, as explained hereinabove with reference to the embodiment of FIG. 3.

The benefit of the embodiment of FIG. 4 is apparent when one considers the planer blade-coil configuration, whereby the thickness of coil 77 is no greater than the thickness of the metallic portions of blades 70, including the thickness of printing surface 76*a*. Thus, a plurality of printing blades 70 may be stacked with negligible separations therebetween, whereby an uninked gap between two adjacent printed dots is minimal and very often undiscernable to unaided vision at reasonable distances. Another advantage is that the entire movable portion, comprising coil 77, rim 73 and printing tip 76, of each blade 70 tends to move in almost translational manner, as the elongation of pivot support 71 increases the effective radius of blade rotation to very large values (approaching or equal to infinity); the velocity at which printing tip 76*a* moves toward impact upon the inked ribbon and media is then essentially equal to the velocity of the center of mass of the entire blade, thus requiring less blade mass (and force generated by coil 77 interacting with a magnetic field to achieve the same acceleration) for generation of large values of kinetic energy at impact. The greatest distance of travel by the center of coils 77 and, hence by all of circular portions 73 and printer tip 76, is facilitated by the greater total flexible length of resilient arms 74 and 75 as enabled by their meander-line configuration. Similarly, as the spring constant of the material utilized for resilient arm 74 and 75 is maintained constant, the elongation of the arms provides a greater return force to shorten the time required for the return of blades 72 its rest condition upon de-energization of coil 77.

The relatively faster printing speeds obtainable with the configurations of FIGS. 3 and 4 may engender an ink wicking problem, whereby ink from the inked ribbon 36 (FIG. 1) is trapped between two adjacent tips to be forced upwardly into the coil or the remainder of the print head, as the print tips oscillate between their rest and impact positions. As seen in FIGS. 5*a*–5*c*, the ink wicking problem is essentially prevented by establishing a series of overlapping apertures 76*b* in each of printing tips 76 a small distance above printing surface 76*a*. Each of apertures 76*b* is at the same distance above print tip 77*a* but apertures formed in adjacent printing tips 76 have their centerlines staggered by an offset distance S with respect to the center of an adjacent aperture, whereby ink, carried in an upward direction between the two adjacent printing tips must encounter at least one of apertures 76*b* which facilitate removal of the frictional force causing upward travel to substantially prevent ink wicking. It should be understood that the travel path for the ink, represented by the overlapping portion 76*c* of adjacent blades (delineated by the shaded area in FIGS. 5*b* and 5*c*) is initially minimized by opposite offsets in the pair of adjacent printing tips whereby apertures 76*b* completely remove all overlapping of at least a portion of adjacent blade areas 76*d*. Similarly, the print tip offset portions may be semicircularly offset in opposite directions as at 76*d*' (FIG. 5*c*) to avoid the additional manufacturing step of forming apertures through the narrow printing tips in a separate step.

Turning now to FIGS. 6 and 6*a*, another embodiment of printing blades 80 effects a compromise between the requirements for generating sufficient dynamic energy to form print marks upon an underlying media (and requiring a relatively large blade mass) and the desirability for maximum coil space factor and small physical print blade size and mass for high speed operation. Blade 80, preferably formed of berylliumcopper, includes a substantially rectangular portion 81 having printing tip 82 integrally formed at one corner thereof. A fixed pivot portion 83 integrally extends from the opposite corner on the same lower side of the blade, and contains an aperture 84 of non-circular cross-section, illustratively square, for receiving therethrough a rigid beam member 85 of similar cross-section. Beam member 85 is formed of a material selected for high resistance to torsional stress to maintain pivot portion 83 at as close to a fixed position as possible during rotation of blade portion 81 and tip 82, as hereinafter more fully explained.

A continuous "square-spiral" patterned aperture 81*a* is etched through the previously solid rectangular body 81 of the blade to form a pair of substantially perpendicular elongated resilient spring arms 88 and 89, each emanating from fixed pivot portion 83; the width of continuous aperture 80*a* narrows after approximately one-third of the distance along lower edge 81*a* of rectangular body portion 81, to form the "square-spiral" coil 87, typically having 15 to 20 complete turns. A first end 87*a* of the coil integrally joins the remaining rectangular conductive blade framework and is electrically connected to fixed pivot portion 83 via conductive spring arms 88 and 89. It should be understood that a plurality of blades 80 are stacked along the length of bar 85, which is of a conductive material to form a common contact with first ends 87*a* of each of the plurality of blade coils 87. The remaining end 87*b* of the coil is the inner-most leg of the etched coil, and has a plurality of inwardly projecting tabs 90 formed and uniformly spaced thereon. The number of tabs 90 on each blade is equal to the number of blades to be stacked in a printhead. All but one different one of tabs 90 are severed from the elongated metallic remaining coil end 87*b* of each blade of the stack to provide a second coil contact point having successively greater spacing from the end of blade 80 closest to beam 85, for each blade having an associated differing position in the stack. Thus, a flexible lead (not shown) is attached to tab 90*a* for the outermost blade of the stack, with flexible leads being attached to spaced apart tabs 90*b*, 90*c* . . . for the second, third, . . . blades into the stack of blades 80. These flexible leads are run through the remaining area of central aperture 80*b* of the stacked blades to appropriate means for causing a current flow through the associated coil and its common contact at beam 85. The interstices of coil 87, provided by the "square-spiral" aperature 80*a*, is filled with an appropriate insulating material, such as epoxy and the like, having sufficient strength to render the coil self-supporting. Thus, a coil having maximum effective length in an externally produced magnetic field, maximum space factor, minimum mass and resistivity is formed of a non-magnetic material. The coil has connection leads formed in a manner to allow blade movement without interference with adjacent blades or their associated coils.

We have found that a blade having a 17 turn etched coil with an effective coil length of approximately 80 centimeters, and energized with three ampere pulses of current in a magnetic field of about four kilogauss, has a character printing rate in the region of 60 characters per second.

Alternatively, as shown in FIG. 6*a*, the upper and lower beams 92 and 93 of blade 80 may be of greater thickness than the thickness of the substantially rectangular middle section 94 in which coil 87 is etched, to provide additional blade rigidity, prevent mechanical interference between adjacent coils and to facilitate a mark, printed by thickened printing tip 82, which has a minimal uninked portion between itself and an adjacent printing tip.

Referring now to FIGS. 7*a*, 7*b*, and 8*a*, a print head 100, capable of use with any of the printing blades described in the present application, is shown. Particular emphasis is made to a final preferred embodiment of printing blade 110 enabling translational motion of its printing tip 111, rather than the relatively rotational printing tip travel facilitated with the printing blades previously described hereinabove.

Printing blade 110 comprises a relatively thick elongated mount portion 112, having a plurality of apertures 113 each receiving a fixed pivot pin 114 (FIG. 8) therethrough to facilitate stacking a plurality, typically seven for a 5 × 7 matrix head, of blades 110 with their thickened mount portions 112 in abutment with each other. A central oval-shaped portion 115 is of relatively less thickness than mount portion 112 and has an aperture 116 formed therethrough of similar oval shape but of slightly smaller dimensions, whereby only a thin-walled oval rim 117 of the non-magnetic, conductive blade material remains. A pair of linearly elongated and substantially parallel resilient spring arms 118 and 119, respectively, couple opposite ends of mount portion 112 to one of outward extensions 117*a* and 117*b*, respectively, formed on rim 117. Outward extension 117*b* is further extended to beam 120 below resilient arm 119 to position the printing tip at a selected distance therefrom. Printing tip 111 is intentionally thickened to the same thickness as utilized for mount portion 112 to provide a substantially square printing surface 111*a* and to facilitate printing of adjacent inked regions with substantially no space therebetween. Typically, for a 5 × 7 matrix character of 0.100 inch height, each of printing tip 111 and mount portion 112 are about 14 mils thick, while the remainder of the integrally-formed blade portions (oval rim 117, arms 118 and 119, etc.) have a thickness of about 12 mils.

A conductive member 122 of oval shape similar to that of rim 117, but of much smaller dimensions, has a central oval aperture 124 bridged by a thin tab 125 at one of a plurality of positions, as shown in broken line by alternative tab positions 125*a*, . . . , 125*g*. The plurality of cross-tabs 125 enable non-interferring connection to each of a stacked plurality of blades 110, in a manner to be more fully described hereinbelow. A single-layer coil 127 of substantially rectangular cross-sectional wire is wound upon member 122, with a first end 127*a* of the wire being bonded to the member, as at point 128, and a remaining, outer-most end 127*b* being bonded to conductive rim 117, as at point 129, to facilitate formation of a common connection at mount portion 112 for all coils of the stacked printing blades.

In operation, translational printing blade 110 is in its rest condition (FIG. 7*a*) with upper rim extension 117*a* resting against a blade stop member 130 when no current flows through coil 127. Both resilient arms 118 and 119 are in their unflexed condition whereby the centerline of oval portion 115 is substantially aligned with a perpendicular bisector of the longest dimension of mount portion 112. An external magnetic structure, to be described hereinbelow with reference to FIG. 8, provides a magnetic field having a first directional vector-illustratively, field $B_1$-emerging from the plane of the drawing towards the viewer in the upper portion 127*c* of coil 127 and having a second and opposite directional vector-illustratively, field $B_2$-directed inwardly into the plane of the drawing from the viewer in the lower portion 127*d* of coil 127. Upon energization of coil 127 by a flow of current therethrough in the proper direction, the current interacts with each of respective magnetic fields $B_1$ or $B_2$ over the portions 127*c* and 127*d*, respectively, of the coil parallel to the rest positions of arms 118 and 119 to produce force components vectorally adding to a total force F directed downwardly in the direction of arrow F toward printing tip 111. Force F (FIG. 7*b*) causes acceleration and movement of central coil-bearing portion 115 and the attached print-tip bearing extension 120 downwardly a distance D from stop member 130 to impact printing tip 111 against the underlying inked ribbon and media (not shown in FIGS. 7*a* or 7*b*, but see FIG. 1). In response to force F, the elongated resilient arms flex as at 118' and 119', respectively. Flexed arms 118' and 119' store an amount of energy commensurate with the total flexure thereof. Upon deenergization (i.e., cessation of current flow in the direction required for movement of print tip 111 in the direction of arrow F), coil 127 ceases to interact with magnetic field B, whereupon generation of force F ceases and print blade 110 reacts solely to the potential energy stored in flexed resilient arms 118' and 119'. The stored potential energy is converted to kinetic energy to move the integrally joined central portion 115, extension beam 120 and print tip 111 in a direction opposite arrow F, to return print blade 110 to its resting condition. Upper rim extension 117*a* moves into contact with stop member 130, which advantageously includes a resilient damping member 131 to absorb the kinetic return energy of the printing blade and thereby prevent oscillatory motion tending to allow print tip 111 to impact the ribbon and media a second time for a single energization of coil 127.

A stack, typically seven in number for printing a 5 × 7 matrix character, of blades 110 is arranged within a housing 140 of printhead 100. Housing 140 has a pair of generally parallel side walls 140*a* and 140*b*, respectively, joined at their respective opposite ends by respective front and rear walls 140*c* and 140*d*, respectively. The remaining opposed top and bottom sides of the housing 140 are initially open to allow assembly of the internal printhead components. Housing wall 140*b* includes an internal shelf-like member 141 having a pair of tapped apertures 142 formed therein for receiving the associated threaded tips of pins 114, which serve to firmly position the relatively thick mount portions 112 of each blade 110 of the stack in abutment with each other and to position the fixed mount portion of the lowermost blade firmly against the shelf-like member. Rear wall 140*d* of the housing includes a tapped aperture 143 for threadedly engaging a threaded member 144. An end of member 144 extending into the volume enclosed by housing 140 and is attached therein to stop member 130. Aperture 143 is so positioned to locate stop member 130 to bear against the outermost surface of rim extension 117*a* of each blade. Advantageously, a channel 145 may be formed into the interior surface of rear wall 140*d* to a depth substantially equal to the thickness of stop member 130 to allow stop member 130 to be withdrawn, by rotation of threaded member 144, during the initial positioning and assembly of the stack of printing blades.

A hollow rectangular housing extension 151, having a slot-like aperture 151*a* formed therethrough, integrally extends outwardly from front wall 140*c* at a location allowing the plurality of print tips 111 to extend upon their associated extension beams 120 into the slot-like aperture. After installation of the stack of printing blades 110 within extension 140, threaded member 144 is adjusted to cause stop member 130 to urge all of printing tips 111 rightwardly (as seen in FIG. 8) until each substantially square printing surface 111*a* is essentially coplanar with all other printing surfaces of the stack of blades and all of the vertically aligned, coplanar printing surfaces are either coplanar with housing front surface 151*b* or are slightly withdrawn within slot-like aperture 151*a* relative to housing front surface 151*b*. Thus, each printing tip will travel the same distance to impact the inked ribbon and media (not shown for purposes of simplicity) and none of print tip surfaces 111*a* extend beyond the front surface 151*b* of the print head housing extension, whereby snagging of the inked ribbon upon an extended edge of a print tip is prevented as the print head traverses the length of the media-supporting platen 32 (FIG. 1). It should be understood that housing extension 151 is advantageously emplaced closely adjacent to housing side wall 140*a* to facilitate viewing of the last printed character past the corners of housing 140 as the head continues its travel along the line of print. It should also be understood that the remaining planar portions of front wall 140*c* and of housing extension 151 may advantageously support means for guiding the inked ribbon past the vertical line of the print tips.

Printhead 100 further includes a bottom cover member 160 having a plurality of apertures 161 formed therethrough for receiving fastening means 162, such as a threaded screw and the like, to mate with tapped apertures 163 within the walls of housing 140 for securely mounting and maintaining cover member 160 across and generally enclosing the previously open bottom surface of the housing. A plurality of mounting tabs 164 integrally extend from the sides of bottom member 160; each mounting tab has at least one aperture 165 formed therethrough to receive means (not shown) for securely mounting the bottom member (and, hence the entire printhead 100) to a printhead movement mechanism (not shown). A pair of elongated permanent magnets 166 and 167, respectively, are fastened upon the interior surface 160*a* of bottom member 160. Magnets 166 and 167 have their magnetic poles in opposed relationship and are mounted at locations selected to position each of magnets 166 and 167, respectively, parallel to the conductors of coil regions 127*c* and 127*d*, respectively.

A top cover member 170 is fabricated to a size and shape selected to completely cover the previously open top surface of housing 140. Cover member 170 includes a plurality of apertures 171 for receiving further fastening members 162 cooperating with additional formations 163 in housing 144 for positioning and maintaining cover member 170 thereupon in like manner as for the fastening of bottom member 160. Top member 170 also includes a pair of elongated permanent magnets 176 and 177 (shown in broken line) fastened upon a bottom surface 170*a* of the member.

Magnets 176 and 177 are magnetized in their thickness directions and have their magnetic poles in opposed relationship to each other and to the magnetic poles of magnets 166 and 167, respectively, which are fastened to bottom member 160. Bottom and top cover member 160 and 170, respectively, are formed of a permeable material, such as iron, to complete the magnetic path between the opposed poles of the magnet, whereby a single magnetic structure causes a single externally produced magnetic field B to be directed through all of stacked coils 127 with a field vector through one coil portion 127 being in a direction parallel but opposite to the magnetic field vector through the other coil portion 127*d*.

Top cover 170 further includes a substantially rectangular aperture 178 having a pair of insulating strips 179 fastened on either side thereof. Insulating strips 179 maintain a plurality of terminal posts 180 upon, but electrically isolated from, conductive top cover 170. A somewhat flattened, very flexible lead 182 connects each cross tab 125 of each printing blade to an associated one of terminal posts 180. Each flexible lead 182 has a substantially L-shaped portion 183 welded to the associated coil crosstab 125 (such as L-shaped end 183*a* fastened to printing blade crosstab 125*a*). The elongated length of each flexible lead 182 runs vertically through the open volume 124 of all overlying blades of the stack, as facilitated by the offset distances between adjacent ones of cross tabs 125 (as best viewed in FIG. 8*a*). The remaining end of each lead 182 is wrapped around the associated terminal post 180 and electrically connected thereto, as by soldering and the like. It should be understood that driving current for each individual printing blade coil is received via cable means (not shown) individually connected to each of posts 180, with a common, or return, lead being fastened to any portion of metallic housing 140, whereby electrical connection is made via pins 114 and fixed mount portions 112 to the remaining coil lead of each blade. In this manner, flexure of coil leads 182 (which advantageously have a greater thickness in the plane parallel to front and rear walls 140*c* and 140*d*, respectively, than in a plane parallel to side walls 140*a* and 140*b*) is achieved essentially into and out of the plane of FIG. 8*a*. It should be further understood that each of flexible leads 182 may be coated with a thin layer of suitable insulation to prevent formation of a short circuit between any two adjacent leads due to inadvertent side-to-side flexure.

Advantageously, bottom plate 160 may have a generally rectangular aperture 160*b* formed therethrough, similar to the aperture 178 formed through top plate 170, to allow heat generated by the operation of printing blades 110 to be dissipated from printhead 100. Further, a plurality of heat-dissipation fins 185 may be formed upon the exterior surface of housing 140, top plate 170 and/or bottom plate 160 (as illustrated) to further facilitate heat transfer away from printhead 100.

There has just been described several embodiments of novel printing blades and an exemplary embodiment of a printhead utilizing a stacked plurality of these printing blades for facilitating dot-matrix printing of characters, symbols and other indicia.

While the present invention has been described with reference to these preferred embodiments, many variations and modifications will now become apparent to those skilled in the art. We intend, therefore, to be limited not by the specific disclosure herein, but only by the scope of the appending claims.

The subject matter which we claim as novel and desire to secure by Letters Patent of the United States is:

1. A printhead for use in a matrix printer, comprising:

a housing having a front wall and a side wall arranged substantially perpendicular thereto;

a plurality of printing blades, each blade having a conductive annular hub member; a substantially planar coil would about said hub member; an annular conductive rim member disposed about the exterior of said coil and in electrical contact with a second end of said coil; a conductive mounting portion positioned in the plane of and spaced from said coil; a pair of conductive elongated resilient arms having opposed first and second ends, the first end of each arm joined to each of a pair of spaced locations on the exterior of said rim member and the second end of each arm joined to said mounting portion, said arms electrically connecting said mounting portion of said second end of said coil and supporting said coil and the hub and rim members for movement relative to said mounting portion; and a printing tip extending from the exterior of said rim member in a first direction substantially perpendicular to the elongated dimension of that one of said arms closest to said tip;

said plurality of blades being stacked with the planes thereof parallel to one another and said mounting portions in parallel alignment;

first means for rigidly fastening only the parallel stacked mounting portions of all said blades to said housing side wall with the plane of each said blade substantially perpendicular to both said front and side walls and with said printing tips aligned along a common line; and second mens positioned only outside the stack of blades for forming a single permanent magnetic field directed to all of the coils of the entire stacked plurality of printing blades;

a plurality of terminal means insulatively fastened to said housing; and means for electrically connecting the hub member of each said printing blade to one of said terminal means;

a flow of current through a coil of one of said blades interacting with said single permanent magnetic field to move the printing tip of that blade in said first direction and outwardly from said front wall of said housing.

2. A printhead as set forth in claim 1, wherein said second means comprises a plurality of permanent magnets each having first and second magnetic poles of opposite polarity; said plurality of permanent magnets being arranged substantially parallel to and spaced from the planes of said printing blades, a portion of said plurality of said permanent magnet being arranged upon each side of said track of printing blades with their first and second magnetic poles respectively facing the respective second and first magnetic poles of the remaining magnets.

3. A printhead for use in a matrix printer, comprising:

a housing having a front wall and a side wall arranged substantially perpendicular thereto;

a plurality of printing blades, each blade having a conductive annular hub member; a substantially planar coil wound about said hub member; an annular conductive rim member disposed about the exterior of said coil and in electrical contact with a second end of said coil; a conductive mounting portion positioned in the plane of and spaced from said coil; a pair of conductive elongated resilient arms having opposed first and second ends, the first end of each arm joined to each of a pair of spaced locations on the exterior of said rim member and the second end of each arm joined to said mounting portion, said arms electrically connecting said mounting portion to said second end of said coil and supporting said coil and hub and rim members for movement relative to said mounting portion; and a printing tip extending from the exterior of said rim member in a first direction substantially perpendicular to the elongated dimension of that one of said arms closest to said tip;

said plurality of blades being stacked with the planes thereof parallel to one another and said mounting portions in parallel alignment;

first means for rigidly fastening only the parallel stacked mounting portions of all said blades to said housing side wall with the plane of each said blade substantially perpendicular to both said front and side walls and with said printing tips aligned along a common line; and second means positioned only outside the stack of blades for forming a single permanent magnetic field directed to all of the coils of the entire stacked plurality of printing blades;

a flow of current through a coil of one of said blades interacting with said single permanent magnetic field to move the printing tip of that blade in said first direction and outwardly from said front wall of said housing;

said printer including means for applying ink to the printing tips of the blades; and each blade having means formed in its printing tip for preventing ink wicking between the printing tips of adjacent blades.

4. A printhead as set forth in claim 3, wherein said ink wicking preventing means comprises a formation in each printing tip providing at least one non-overlapping area between printing tips of adjacent blades to prevent capillary ink flow therebetween.

5. A matrix printhead comprising:

a housing;

a plurality of printing blades each comprising: a printing tip;

an armature displaced from said printing tip;

a blade member substantially rigidly connecting said armature and said printing tip;

a fixed pivot portion displaced from said blade member, said printing tip and said armature; and a pair of resilient arms spaced from said blade member and each having a first end connected to said pivot portion and a second end, the second end of a first one of said arms connected to said blade member adjacent an end thereof bearing said printing tip and the second end of the remaining arms connected to said blade member adjacent the remaining end supporting said armature;

said plurality of printing blades being stack-arranged with the plane of each printing blade being substantially parallel to the plane of all others of the printing blades, the printing tips of all of said plurality of printing blades being aligned along a common line and the pivot portions of all of said plurality of said printing blades being aligned parallel to one another and to said common line;

means for rigidly fastening all of the aligned and parallel stacked pivot portions of said plurality of printing blades to said housing;

means formed in the printing tips of said printing blades for preventing ink wicking between the printing tips of adjacent blades; and a like plurality of means for selectively generating a magnetic field, one of said plurality of generating means being attached to said housing and positioned adjacent to the armature of each of said printing blades to cause rotation of the printing tip thereof in a first direction away from said common line of printing tips responsive to selective energization of only the magnetic field generating means associated with that one printing blade; each printing tip being returned to said common line upon de-energization of the associated magnetic field generating means responsive to the energy stored in the resilient arms of the associated printing blade.

6. A printing head as set forth in claim 5, wherein said housing has a semicircular shape in a plane parallel to the plane of said printing blades, each of said magnetic field generating means being positioned upon the periphery of said semicircular housing with substantially equiangular spacing therebetween; each blade member having a first end integrally joined to said printing tip and a second end integrally joined to said armature means, each said blade member having a shape between said first and second ends predeterminately selected to allow the associated armature means to be positioned adjacent to a selected one of said plurality of equiangular positioned magnetic field generating means while maintaining said printing tips of all of said plurality of printing blades along said common line.

7. A printhead as set forth in claim 5, wherein said ink wicking preventing means comprises a formation in each printing tip providing at least one non-overlapping area between adjacent printing tip to prevent capillary ink flow.

* * * * *